United States Patent [19]

Gibson

[11] 4,447,144

[45] May 8, 1984

[54] GROOVED ROLLER SUPPORT FOR A BELT XEROGRAPHIC PHOTOCONDUCTOR

[75] Inventor: David K. Gibson, Boulder, Colo.

[73] Assignee: International Business Machines Corporation, Armonk, N.Y.

[21] Appl. No.: 447,744

[22] Filed: Dec. 8, 1982

[51] Int. Cl.[3] ..... G03G 15/00

[52] U.S. Cl. ..... 355/3 BE; 355/15; 118/652

[58] Field of Search ..... 355/3 BE, 3 R, 15, 16, 355/3 DD; 118/652; 29/121.1

[56] References Cited

U.S. PATENT DOCUMENTS

| | | | |
|---|---|---|---|
| 3,807,853 | 4/1974 | Hudson | 355/15 |
| 3,834,804 | 9/1974 | Bhagat et al. | 355/3 R |
| 4,018,187 | 4/1977 | Abbott et al. | 118/658 |
| 4,059,353 | 11/1977 | Shaffer | 355/16 |
| 4,127,082 | 11/1978 | Kawabata | 118/652 |
| 4,147,834 | 4/1979 | Munzel et al. | 428/407 |
| 4,150,987 | 4/1979 | Anderson et al. | 96/1.5 R |
| 4,183,655 | 1/1980 | Umahashi et al. | 355/15 X |

OTHER PUBLICATIONS

IBM Technical Disclosure Bulletin, vol. 22, No. 10, Mar. 1980, "Bead and Debris Control by Open Mesh Screen", by J. K. Fortin, p. 4397.

IBM Technical Disclosure Bulletin, vol 24, No. 7B, Dec. 1981, "Carrier Bead Scavenger", by J. E. Bierschbach et al., pp. 3780–3781.

*Primary Examiner*—R. L. Moses

*Attorney, Agent, or Firm*—Francis A. Sirr

[57] ABSTRACT

A xerographic reproduction device with a reusable, closed-loop, belt photoconductor, having the photoconductor supported by at least one roller whose surface is axially grooved. These grooves are dimensioned to accept and hold carrier beads at or below the surface of the roller. As carrier beads accumulate in a groove, they move longitudinally of the roller, to accept more beads. The beads thereby move to the end of the roller and are discharged, preferably to a bead-capturing device.

10 Claims, 2 Drawing Figures

GROOVED ROLLER SUPPORT FOR A BELT XEROGRAPHIC PHOTOCONDUCTOR

DESCRIPTION

1. Field of the Invention

This invention relates to xerography, and more particularly to means for supporting the cyclic run of a reusable xerographic photoconductor belt.

2. Background of the Invention

The advent of modern, high speed xerographic reproduction devices, i.e. copiers and printers, has led to the use of relatively long, belt photoconductors. In these devices, a number of latent images are carried by one revolution of the photoconductor, as the photoconductor cycles past the various xerographic stations. The photoconductor is supported by both driving and idler rollers.

U.S. Pat. No. 4,059,353 is exemplary of this type of device, and is incorporated herein by reference for the purpose of showing the state of the art to which the present invention pertains. This patent recognizes the disadvantage of a belt photoconductor, where contamination on the back side (i.e., the unused side) of the photoconductor is likely to damage the same.

More specifically, this patent provides an open-area mesh cloth which cooperates with flat runs of the belt. A vacuum plenum pulls the belt onto the mesh cloth, and xerographic toner, which may have accumulated on the back of the belt, is scraped off and captured by the mesh of the cloth.

The *IBM Technical Disclosure Bulletin* of Mar. 1980, at page 4397, shows such a mesh cloth in greater detail, and states that the cloth can be used to capture carrier beads, i.e., the relatively large beads of a xerographic developer mix which triboelectrically interact with the small toner particles within a developer station.

Carrier beads are not a consumable. That is, they are intended to last a relatively long time, for example hundreds of thousands of copies. Unfortunately, however, carrier beads may escape from the developer. If these fugitive beads find their way under the photoconductor belt, the belt can be damaged, and in a manner which is apparent on the copies being produced. Damage occurs from the abrupt bend which occurs at the location of the carrier bead. This deformation of the photoconductor can, for example, cause corona arcing as the deformation passes under the device's charge corona.

One of the more popular developer stations is the magnetic brush developer, for example as shown in aforesaid U.S. Pat. No. 4,059,353. Carrier beads used in this developer are made of magnetic material, and these fugitive beads can be captured by a magnetic field. The *IBM Technical Disclosure Bulletin* of Dec. 1981, at page 3780, shows a drum-type xerographic device where a strategically placed magnet captures fugitive carrier beads in a manner which prevents their migration under the photoconductor.

Means have also been provided to clean fugitive beads from the front, working surface of the photoconductor. For example, U.S. Pat. No. 3,834,804 shows a magnetic roller engaging the photoconductor's working surface. This roller is of a rough finish, to assist in conveying carrier beads away from the photoconductor's surface. At a position displaced from the roller's cleaning nip with the photoconductor, the magnetic field decreases, such that the carrier beads fall off the roller, into a container, by operation of gravity.

U.S. Pat. Nos. 3,807,853 and 4,127,082 are perhaps of interest to the present invention in that they show rollers whose surface texturing facilitates removal of material from an adjacent surface. In U.S. Pat. 3,807,853 a cellular-surfaced roller operates to clean the working surface of a xerographic photoconductor. In U.S. Pat. No. 4,127,082 a grooved roller operates to remove excess liquid developer from a wet sheet which has just passed through the liquid developing station of a copying machine.

As will be apparent, the present invention makes unique use of one or more grooved rollers. A further patent which should be noted, merely because it shows a grooved roller, is U.S. Pat. No. 4,018,187. This patent shows the roller of a magnetic brush developer, which roller contains axial grooves of a circumferential dimension 2 to 3 times the diameter of the carrier beads, and of a depth 1 to 2 times the bead diameter.

THE INVENTION

The present invention is related to a unique means of handling fugitive carrier beads which have found their way onto the back side of a belt photoconductor.

More specifically, the present invention provides one or more belt-supporting rollers, having generally V-shaped grooves which accept fugitive carrier beads such that the beads do not extend above, or at least not appreciably above, the surface of the roller. As a result, the photoconductor is not subjected to localized stress as it passes over the roller and its groove-held beads.

An important feature of the present invention is that the roller's grooves are so proportioned and spaced, in relation to the size of the carrier beads, that the beads always move to a groove and are never held intermediate the photoconductor and the surface of the roller intermediate two adjacent grooves.

Another important feature of the present invention is that the grooves are so proportioned that beads can move down the axial length of the roller, until beads are transported out of the ends of the grooves, preferably to be collected in a tray, by a magnet, or the like.

While the present invention is limited to the field of belt xerographic devices, the specific configuration of such a device is not critical to use of the present invention. Thus, the present invention will not be described in the environment of the totality of such a device, and will be described only in the environment of one belt-support roller made in accordance with the present invention. It will be left to those skilled in the art to use the present invention in any device-configuration that seems appropriate.

While the figures show a belt-support roller having parallel grooves, which are in turn parallel to the axis of a circular-cylinder roller, it is within the present invention to provide, for example, spiral grooves and/or a crowned roller.

The term carrier beads as used herein is intended to mean all of those relatively large particles which have heretofore been used to triboelectrically interact with xerographic toner. Within the teachings of the present invention, however, it is preferable that all carrier beads be generally spherical and of the same size.

A particularly fine carrier for use in the present invention is defined in U.S. Pat. No. 4,147,834. This patent describes carrier intended for use in magnetic brush developers. The carrier comprises a ferromagnetic, electrically conductive, spherical core, of a size from 50 to 600 microns, and preferably 300 microns. This core is coated with a fluoropolymer to a uniform thickness of about 10 microns. This carrier is used with toner particles of generally the size 10 microns.

BRIEF DESCRIPTION OF THE DRAWINGS

Referring now to FIG. 1, a circular-cylinder roller 10, of about two inches diameter and eighteen inches axial length, is shown supporting a belt xerographic photoconductor 20, as the photoconductor wraps a portion of the roller, in this case in excess of 180°. Photoconductor belt 20 is under an exemplary tension of about 11 pounds. The present invention is of special utility in situations where photoconductor 20 wraps a small-diameter roller 10, since it is these sharp-bend situations which produce the greatest propensity to photoconductor damage by the presence of a carrier bead between prior art rollers and the underside of the photoconductor.

Figure 1:
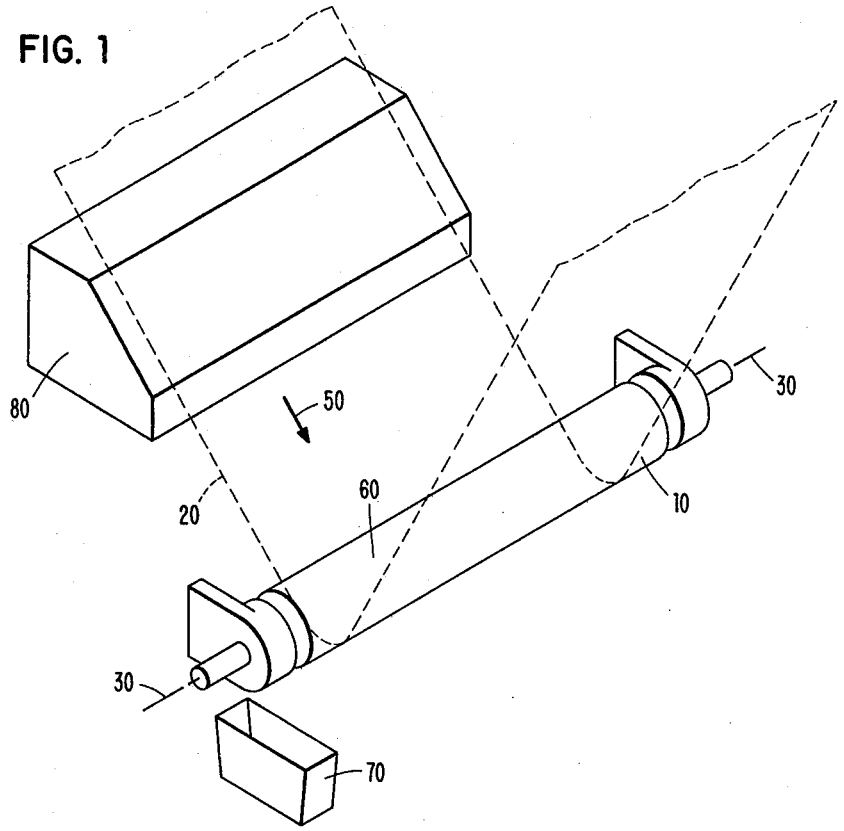
FIG. 1 shows an embodiment of the invention where a belt photoconductor wraps a portion of an idler roller in the vicinity of a magnetic brush developer.

Photoconductor 20 is about 0.003 inch thick. It is a layered, organic photoconductor of the type generally described in U.S. Pat. No. 4,150,987. This photoconductor, and other thin photoconductors exhibit a propensity to damage if creased or subjected to localized pin-like pressure.

Roller 10 is an idler roller, and it is mounted for rotation on an axis 30 which is perpendicular to the direction 50 of photoconductor movement.

Magnetic brush developer 80 is shown associated with photoconductor 20, at a position immediately prior to roller 10.

Figure 2:
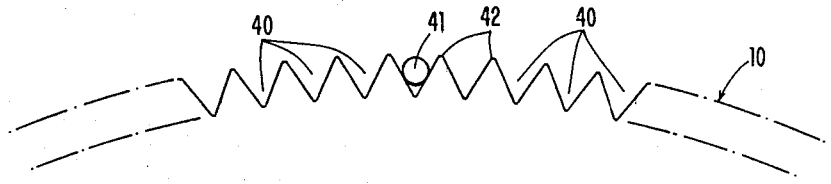
FIG. 2 shows an enlarged portion of the idler roller of FIG. 1, the V-shaped grooves formed in the surface of the roller, and an exemplary carrier bead located in one of the grooves.

FIG. 2 shows an enlarged portion of roller 10. The entire surface of roller 10 is covered by generally V-shaped grooves 40 whose bottom apex lies on a radius of the roller's cross section. The roller portion 42 at which grooves 40 meet is circumferentially very narrow, and in FIG. 2 it is a line. This construction and arrangement is critical since a bead must never reside on portion 40, but rather, must always be pushed to an adjacent groove by photoconductor tension. These grooves are not visible in FIG. 1 due to their small size. For the exemplary carrier of U. S. Pat. No. 4,147,834, i.e. carrier beads which are all of one uniform size, and about 300 microns, the roller's grooves are of about this same width and depth—see the 300 micron bead 41 of FIG. 2.

As used herein, the term generally V-shaped is intended to mean a groove shape which allows adjacent grooves to meet at a line, or a sharp radius, 42, such that it is impossible for a bead 41 to not move to an adjacent groove 40, as the bead is trapped between roller 10 and the underside of photoconductor 20.

In addition, grooves 40 must not be so deep and wide that adjacent peaks or lines 42 cause photoconductor 20 to establish a flat run between these adjacent peaks. If such were to occur, this "creasing" of the photoconductor may damage the photoconductor. Thus, ideally, grooves 40 are, in cross section, an equilateral triangle whose dimensions are such that a carrier-bead-diameter (300 microns) circle (41 of FIG. 2), placed inside the triangle, is tangent to the center of each triangle leg, at leg midpoint.

Adjacent grooves meet in a line 42, or may be spaced a greater circumferential distance, such that surface 42 is of small radius. In either event, a carrier bead cannot hang-up on roller surface 42, but rather falls into one of the two adjacent grooves 40.

Roller 10 is formed of a metal such as aluminum. Grooves 40 are machined into the roller, and preferably are triangular in cross section.

The beads 41 which reside in grooves 40 are free to move axially of the roller, as more beads are picked up by the roller. As a result, should a groove become full of beads, or reasonably so, so that a bead moves to the end of its particular groove, then, that bead drops out of the end of the groove and is caught by a receptacle, one of which is shown at 70 in FIG. 1.

It is not critical that the beads remain in a groove when the beads move to a roller area 60 (FIG. 1) where photoconductor 20 does not wrap the groove and its carrier bead. If the bead is thrown out of the groove, it may well land on the photoconductor, and again come into the influence of roller 10 and its grooves 40, to be again held thereby. In any event, as beads accumulate, they can move axially of the roller, and be discharged as aforesaid.

While the invention has been particularly shown and described with reference to preferred embodiments thereof, it will be understood by those skilled in the art that various changes in form and details may be made therein without departing from the spirit and scope of the invention.

What is claimed is:

1. An electrophotographic reproduction device having a photoconductor belt for receiving toner images from a developer station containing a mix of toner powder and carrier beads;

at least one roller for supporting said belt by means of engagement with the nonworking, underside of the belt; and a plurality of generally axially extending, generally V-shaped grooves formed in said roller, said grooves being dimensioned relative the size of said carrier beads so as to hold beads which may escape from the developer and find their way under the photoconductor, said grooves being radially deep enough to conceal said beads from damaging contact to said photoconductor, and being circumferentially closely spaced so as not to form a transverse crease in the photoconductor as the photoconductor wraps a portion of said roller.

2. The device of claim 1 wherein said grooves are open on at least one axial end of the roller, such that as a plurality of beads move into a given groove, the beads move axially of the roller until beads are discharged out of the end of the groove.

3. The device of claim 2 including means to collect beads which are discharged from said end of the grooves.

4. The device of claim 1 wherein said photoconductor is an organic, layered photoconductor, said roller is a metal roller, said carrier beads are spheres coated with a polymer that is triboelectrically interactive with said toner, and said grooves have a triangular cross section which is dimensioned to tangentially contain the circumference of said spheres.

5. The device of claim 4 wherein the developer station is a magnetic brush developer and the carrier beads include a core of magnetically permeable metal.

6. The device of claim 1 wherein said roller is in the form of a circular-cylinder and said grooves are parallel to the axis of said roller.

7. The device of claim 2 wherein said roller is in the form of a circular-cylinder and said grooves are parallel to the axis of said roller.

8. The device of claim 3 wherein said roller is in the form of a circular-cylinder and said grooves are parallel to the axis of said roller.

9. The device of claim 4 wherein said roller is in the form of a circular-cylinder and said grooves are parallel to the axis of said roller.

10. The device of claim 5 wherein said roller is in the form of a circular-cylinder and said grooves are parallel to the axis of said roller.

* * * * *